US007037384B2

(12) United States Patent
Pawloski

(10) Patent No.: US 7,037,384 B2
(45) Date of Patent: May 2, 2006

(54) LUBRICATING CHEMICAL COATING FOR METALWORKING

(75) Inventor: David Roy Pawloski, Lafayette, NY (US)

(73) Assignee: Bulk Chemicals, Inc., Reading, PA (US)

( * ) Notice: Subject to any disclaimer, the term of this patent is extended or adjusted under 35 U.S.C. 154(b) by 3 days.

(21) Appl. No.: 10/601,939

(22) Filed: Jun. 23, 2003

(65) Prior Publication Data

US 2004/0255818 A1 Dec. 23, 2004

(51) Int. Cl.
*C23C 22/00* (2006.01)
*C23F 11/00* (2006.01)

(52) U.S. Cl. ..... 148/243; 106/14.05; 106/14.13; 106/14.41; 106/14.44; 148/246; 148/248; 148/252; 148/269; 148/274; 148/275

(58) Field of Classification Search ..... 106/14.05, 106/14.13, 14.41, 14.44; 148/243, 246, 248, 148/252, 269, 274, 275
See application file for complete search history.

(56) References Cited

U.S. PATENT DOCUMENTS

| | | | | |
|---|---|---|---|---|
| 3,879,208 | A * | 4/1975 | Cassens, Jr. | 501/109 |
| 4,401,526 | A * | 8/1983 | Martin | 205/245 |
| 4,659,439 | A | 4/1987 | Watanabe et al. | |
| 4,824,490 | A | 4/1989 | Oei et al. | |
| 4,971,724 | A | 11/1990 | Kalota et al. | |
| 5,169,458 | A | 12/1992 | Shulman et al. | |
| 5,607,623 | A | 3/1997 | Benton et al. | |
| 5,954,892 | A | 9/1999 | Musingo et al. | |
| 6,204,227 | B1 | 3/2001 | Rao et al. | |
| 6,447,717 | B1 | 9/2002 | Fan et al. | |
| 6,455,476 | B1 | 9/2002 | Imai et al. | |
| 6,695,901 | B1 * | 2/2004 | Diesso | 106/35 |
| 2002/0124773 | A1 | 9/2002 | Diesso | |

FOREIGN PATENT DOCUMENTS

| | | | |
|---|---|---|---|
| CN | 1153593 | A | 7/1997 |
| JP | 2-197836 | | 8/1990 |
| JP | 2-197836 | A * | 8/1990 |
| JP | 4-170368 | | 6/1992 |
| JP | 4-170368 | A * | 6/1992 |
| JP | 5-127323 | | 5/1993 |
| JP | 5-127323 | A * | 5/1993 |
| JP | 6-194791 | | 7/1994 |
| JP | 6-194791 | A * | 7/1994 |

OTHER PUBLICATIONS

Derwent Abstract No. 2003-732279, abstract of Chinese Patent Specification No. 1153593A (Jul. 1997).*

* cited by examiner

*Primary Examiner*—Anthony J. Green
(74) *Attorney, Agent, or Firm*—RatnerPrestia

(57) ABSTRACT

A composition for treating the surface of a ferrous metal. The composition comprises aluminum sulfate, boric acid or a boric acid precursor, and polycarboxylic acid or salt thereof. Treatment of the ferrous metal with an aqueous solution of the composition at elevated temperature and low pH provides a coating that imparts lubricity to the metal, thereby facilitating metalworking processes such as drawing for wire production.

18 Claims, No Drawings

LUBRICATING CHEMICAL COATING FOR METALWORKING

FIELD OF THE INVENTION

The invention relates to coatings for metalworking. More particularly, it relates to a composition applied to ferrous metals from an aqueous mixture. The composition provides a coating imparting improved lubricity to the metal, facilitating metalworking operations such as wire drawing.

BACKGROUND OF THE INVENTION

Metalworking processes of many kinds are used in the fabrication of metal goods, and include operations in which the metal is formed by ductile flow with no removal of metal. Examples of such metalworking operations include rolling, forging, molding, stamping, casting, ironing, drawing, and extruding. In one type of metalworking operation, the metal is preheated to at least about 800° C. so that it can be more easily formed into the desired shape.

In addition to such hot fabrication methods, cold working techniques are also practiced. Cold working involves the physical deformation of a metal article (e.g., a blank, slug, or preform) at a temperature well below the recrystallization temperature of the metal, and preferably within about 200° F. of room temperature. Typical cold working processes include cold extrusion, cold heading, and wire and tube pulling deformation operations.

In order to deform a metal article, all cold working processes involve contacting the metal article with at least one die to work the metal article. When a metal is passed through a die during cold working, the friction between the metal being worked and the die causes the generation of heat. The heat caused by work hardening during deformation also increases the temperature of the die surface and the metal article. The generated heat, in turn, can have detrimental effects on both the dies and on the metal articles. For example, the die can wear rapidly due to the generated heat. Also, the heat can generate impurities on the surface of the metal article.

Accordingly, it is desirable to reduce the friction by applying a lubricant to the metal surface and/or the die in order to avoid or minimize the generation of heat during cold working. In order for a lubricant to remain in contact with the metal during one or more cold working drawings, a coating (i.e., a lubricant carrier) is typically first adhered to the metal surface.

Numerous zinc phosphate coatings have been proposed in order to achieve this function as a lubricant carrier. It is well known to form metal phosphate coatings by the application of an aqueous acidic phosphatizing solution to metal surfaces. The surface of the metal reacts with the solution to form an integral layer of substantially insoluble crystalline phosphate on the surface of the metal. This crystalline layer increases the ability of the metal to retain a uniform film of lubricant over the entire surface. This lubricant reduces metal to metal contact in cold forming operations. In addition to serving as a lubricant carrier in preparation for cold working, some zinc phosphate coatings can improve corrosion resistance of the metal surface and improve the adhesion of paint to the metal surface.

For example, U.S. Pat. No. 5,588,989 to Vonk et al. discloses the use of an oxime accelerator in a zinc phosphate bath which may also contain fluoride ions, nitrate ions, and ions of various metals, such as nickel, cobalt, calcium, magnesium, manganese, and iron.

In addition, U.S. Pat. No. 5,603,818 to Brent et al. is directed to a process for treating metal parts to provide rust-inhibiting coatings in at least five discrete steps. The first step in this process is the use of an aqueous phosphatizing solution that is used to deposit a phosphate coating on a metal surface. Various inorganic phosphate solutions are suggested, including zinc phosphate. Chlorate ions are disclosed as an additive to the phosphate solution.

The zinc phosphate process however carries with it a number of disadvantages. It involves the use of a heavy metal, zinc, and thus is not ideal from an ecological perspective. The phosphate process also produces a ferric phosphate sludge, which requires periodic shutdown of the process for manual removal, with resulting costs to productivity and additional costs for the disposal of the waste such as hauling costs and expenses related to obtaining permits for the disposal. There is also required a rinsing step after the application of the phosphate treatment, to stop the reaction, and there results from this an ongoing waste treatment of the rinse water. A further rinse, usually employing lime or borax, is then performed in yet another tank. Beyond all of these inconveniences and expenses, there is typically an emission of nitrogen oxides from the treatment bath, requiring appropriate personnel and environmental protection measures.

Thus there would be a benefit to providing methods of imparting lubricity to ferrous metals, without the use of traditional zinc phosphate methods.

SUMMARY OF THE INVENTION

In one aspect, the invention is a composition for treating the surface of a ferrous metal. The composition comprises at least one of aluminum sulfate and an aluminum sulfate precursor, at least one of boric acid and a boric acid precursor, and at least one of a polycarboxylic acid and a polycarboxylic acid precursor.

In another aspect, the invention is a method for treating the surface of a ferrous metal. The method comprises contacting the surface of a ferrous metal with an aqueous mixture comprising aluminum sulfate, boric acid, and a polycarboxylic acid.

In yet another aspect, the invention is an aqueous mixture for treating the surface of a ferrous metal. The mixture comprises aluminum sulfate, boric acid, and a polycarboxylic acid.

In a further aspect, the invention is a method for making an aqueous mixture for treating the surface of a ferrous metal. The method comprises mixing together at least one of aluminum sulfate and an aluminum sulfate precursor, at least one of boric acid and a boric acid precursor, at least one of a polycarboxylic acid and a polycarboxylic acid precursor, and water.

It is to be understood that both the foregoing general description and the following detailed description are exemplary, but not restrictive, of the invention.

DETAILED DESCRIPTION OF THE INVENTION

The present invention is directed to imparting lubricity for metalworking processes, such as drawing for wire production. The invention contemplates a composition and process for providing a surface treatment providing this lubricity. The composition is applied to a ferrous metal from an aqueous mixture, at a pH that is sufficiently acidic to create a chemical reaction on the surface of the metal. The composition comprises aluminum sulfate (or an aluminum sulfate precursor), boric acid (or boric acid precursor), and one or more polycarboxylic acids or precursors thereof. The composition optionally includes a polyol, a rust inhibitor, a polymeric polyacid, and/or an anticaking agent such as fumed silica. Other additives may be included as well, to meet specific needs of specific applications. The surface treatment composition may be in solid form, or may be in the form of an aqueous solution and/or slurry of materials.

The composition may be prepared by blending the components to form a mixture, with the mixture later dissolved and/or dispersed in water prior to use as described below. It is not necessary however that any of the components be mixed prior to being dissolved and/or dispersed in water. Thus, alternatively, one or more of the components may be added to the water individually or together in any sequence, providing that the resulting aqueous mixture comprises aluminum sulfate, boric acid, and a polycarboxylic acid at the time of application.

The manner in which these materials are provided to produce the composition is not critical, and thus may include any of a number of materials and sequences of addition. For example, any of the three primary ingredients may be added directly, or may be formed from precursors, as is described below. Conversion of precursors may be performed by any convenient means such as are known in the chemical art. A wide variety of such means are known, including for example adding a strong acid such as sulfuric acid, and optionally heating the resulting mixture.

For any such precursor, it is not necessary that all of it be converted into the desired form, only that a substantial amount be so converted. Similarly, even in the case where each of the three primary ingredients is added as the named compounds themselves, it will be appreciated that each of them may be converted to other species in solution by equilibration with related species, and/or by reaction with one or more of the other ingredients. Typically however, it is envisioned that the named primary ingredients, rather than precursors thereof, will be used, for reasons of convenience and cost.

Aluminum sulfate suitable for use in practicing the invention may be of essentially any commercially available grade. As used herein, amounts of aluminum sulfate recited in the text refer to commercially available aluminum sulfate hydrate, according to the formula $Al_2(SO_4)_3 \cdot xH_2O$, where x is a number between 14 and 18. Anhydrous aluminum sulfate may also be used, with adjustment made in order to provide the same amount of aluminum. Aqueous aluminum sulfate may also be used, with adjustment made on the same basis. Alternatively, or in addition, aluminum sulfate may be generated in situ from an aluminum sulfate precursor, at a time prior to treatment of the ferrous metal. By "aluminum sulfate precursor" is meant a material that converts at least partially to aluminum sulfate prior to treatment of the ferrous metal. Thus for example alumina trihydrate may be used in place of aluminum sulfate, providing that it is converted via reaction with sulfuric acid to aluminum sulfate prior to treatment of the ferrous metal. The aluminum sulfate or its precursor may be present in a dry basis amount (reported as $Al_2(SO_4)_3 \cdot 16H_2O$) of between about 30 wt. % and about 90 wt. % of the composition, preferably between about 40 wt. % and about 80 wt. %, and more nreferablv between about 50 wt. % and about 70 wt. %. The term "dry basis" as used herein refers to composition percentages not including water added as a solvent or dispersant for the composition. Thus, $Al_2(SO_4)_3 \cdot 16H_2O$ is 100% aluminum sulfate on a dry basis, because the water in the hydrate is chemically bound and not added as a solvent or dispersant.

Boric acid suitable for use in practicing the invention may be of essentially any commercially available grade. Alternatively, the boric acid may be generated in situ from other materials, referred to herein as "boric acid precursors", at a time prior to treatment of the ferrous metal. Examples of boric acid precursors may include, but are not limited to, disodium tetraborate pentahydrate, disodium tetraborate decahydrate (borax), disodium tetraborate (anhydrous borax), sodium metaborate, boron oxide, and mixtures of any of these. Under the low-pH conditions of use of the composition of this invention (to be described below), all of these materials will be largely converted to boric acid. The amounts of these materials, if used, are chosen so as to provide essentially the same amount of boric acid as would be present if boric acid itself had been used. The boric acid or its precursor material may be present in a dry basis amount of between about 5 wt. % and about 35 wt. % of the composition, preferably between about 10 wt. % and about 20 wt. %, measured as boric acid.

Polycarboxylic acids suitable for use in practicing the invention are organic acids having two or more carboxylic acid groups per molecule. The polycarboxylic acid may itself be used, or may be formed from a polycarboxylic acid precursor. Such a precursor may for example be a water-soluble salt (typically sodium, potassium, or ammonium), or in a form comprising both acid and salt form of the polycarboxylic acid. Or the precursor may be an ester or anhydride form of the polycarboxylic acid, which may be converted to the ester form by hydrolysis in the acidic aqueous mixture used for treating the ferrous metal. Under the low-pH conditions of the composition as it is used (see below), all of these species are substantially converted by equilibration to their acid form in the aqueous mixture, regardless of the degree of neutralization of the polycarboxylic acid in the starting composition. Suitable polycarboxylic acids for use in practicing the invention include, but are not limited to, oxalic acid, malonic acid, succinic acid, glutaric acid, adipic acid, azelaic acid, citric acid, aspartic acid, glutamic acid, and mixtures of any of these. The polycarboxylic acid or its precursor may be present in a dry basis amount of between about 2 wt. % and about 15 wt. % of the composition, preferably between about 2 wt. % and about 5 wt. %. In some formulations, the amount may be higher, for example about 10 wt. % to about 20 wt. %.

In a preferred embodiment of the invention, the polycarboxylic acid comprises at least one of oxalic acid and citric acid, and at least one of adipic acid and azelaic acid. In one exemplary embodiment, the formulation comprises between about 40 wt. % and about 80 wt. % of aluminum sulfate, between about 10 wt. % and about 20 wt. % total of at least one of boric acid and a boric acid precursor, and between about 10 wt. % and about 20 wt. % of at least one of a polycarboxylic acid and a polycarboxylic acid precursor. Such a formulation may, in another embodiment, additionally include between about 5 wt. % and about 10 wt. % of citric acid, between about 2 wt. % and about 5 wt. % of pentaerythritol, between about 2 wt. % and about 5 wt. % of adipic acid, and between about 1 wt. % and about 3 Wt. % of L-aspartic acid. In yet another exemplary embodiment, the invention provides a composition comprising between about 50 wt. % and about 70 wt. % of aluminum sulfate, between about 10 wt. % and about 15 wt. % of boric acid, between about 5 wt. % and about 15 wt. % of oxalic acid, between about 2 wt. % and about 7 wt. % of citric acid, between about 2 wt. % and about 7 wt. % of adipic acid, between about 1 wt. % and about 5 wt. % of pentaerythritol, between about 1 wt. % and about 5 wt. % of trimethylolpropane, between about 0.5 wt. % and about 2 wt. % of azelaic acid, and between about 1 wt. % and about 5 wt. % of L-aspartic acid, D-aspartic acid, or a mixture thereof.

The composition may also comprise a polyol, which acts as a lubricity-enhancing agent. Examples of polyols suitable for use in practicing the invention include, but are not limited to, trimethylolpropane, pentaerythritol, dipentaerythritol, and mixtures of any of these. By incorporating such a polyol, a decrease in friction may be achieved when ferrous metal treated with the composition is subjected to forming operations. The exact reason for the improvement is not clear. However, and without wishing to be bound or limited by this explanation, it is believed that some formation of ester linkages may occur between the polyol and one or both of the polycarboxylic acid and boric acid under the transient high temperature conditions during wire drawing or similar metal working operations. The polyol may be present in a dry basis amount of between about 2 wt. % and about 10 wt. % of the composition, preferably between about 2 wt. % and about 5 wt. %.

The composition may also comprise a rust inhibitor. Suitable rust inhibitors for use in practicing the invention include, but are not limited to, L-aspartic acid, D-aspartic acid, glutamic acid, and mixtures of any of these. The rust inhibitor may be present in a dry basis amount of between about 2 wt. % and about 15 wt. % of the composition, preferably between about 2 wt. % and about 7 wt. %.

The composition may also comprise one or more other materials included for special purposes. Such other materials may include, but are not limited to, graphite and/or polyacrylic acid (such as for example K-739, available from B.F. Goodrich) for increased sliding lubrication, and an anticaking agent. Nonlimiting examples of anticaking agents are a fumed silica such as Aerosil® 200 (available from Degussa Corporation of Ridgefield Park, N.J.) and a calcium silicate such as Microcel® (available from Atochem of Philadelphia, Pa.). The total combined other materials may be present in a dry basis amount of between about 0.3 wt. % and about 3.0 wt. % of the composition, preferably between about 0.3 wt. % and about 2 wt. %.

The intermixing of the aluminum sulfate, the boric acid, and the polycarboxylic acid (and/or the precursors of any of these) within the aqueous solution may be done at the same time or prior to the addition of the other components. It can be seen that the mixing sequence and procedure is not critical to the present invention. For example, in one embodiment, a pre-formed dry mixture of aluminum sulfate, boric acid, polycarboxylic acid, and any of the optional ingredients may be dissolved in water. Alternatively, these ingredients may be added individually or in subcombination mixtures to water, or water may be added to the ingredients. Many other variations will be apparent to those skilled in the chemical art.

It can be further seen that the relative weight percentages of the constituents that form the composition and the aqueous mixture comprising the composition may be varied. As such, the relative weight percentages of the constituents mixed to form the present invention are not critical. Compositions and aqueous mixtures formed from components mixed together with weight percentages differing from those in the exemplary embodiment may still be included within the scope of the present invention.

The process for using the composition to surface-treat a ferrous metal involves diluting the composition in water, optionally adjusting the pH of the aqueous mixture, optionally heating the composition, and contacting the metal surface with the composition to cause a reaction to form a coating.

The composition of the invention is first dissolved and/or dispersed in water prior to use, using mixing techniques and equipment well known to those skilled in the art. The composition may be present at a concentration between about 2 wt. % and about 40 wt. % of the aqueous mixture, preferably between about 5 wt. % and about 30 wt. %. Optionally, the pH of the resulting aqueous mixture is adjusted to between about 1 and about 4, preferably about 3 (if it is not already at that level). Downward adjustment of the pH of the aqueous mixture, if desired, may be performed with any strong acid, including but not limited to sulfuric acid, nitric acid, and phosphoric acid. Hydrochloric acid may be used but is less preferred, as it increases the presence of chloride ion, which may increase corrosion of the ferrous metal. Upward adjustment of pH, if desired, may be performed by adding any of a number of alkaline materials, including as nonlimiting examples alkali metal or ammonium hydroxides or carbonates.

Optionally, the aqueous mixture is brought to a temperature between about 120° F. and about 210° F. prior to contacting the surface of the ferrous metal with it. If the ferrous metal is a low-carbon steel, it is preferred that the temperature of the aqueous mixture be between about 185° F. and about 200° F. If medium-carbon steel is used, the preferred temperature is between about 170° F. and about 200° F., and if high-carbon steel is used, the preferred temperature is between about 150° F. and about 200° F.

It will be appreciated that there is an interrelationship between reaction time, temperature, ingredient concentration, and pH in the chemical reactions involved in the treatment process according to the invention, and thus a range of combinations of these variables may be suitable for performing the treatment operation. In general higher concentrations of the ingredients in the aqueous composition, and higher treatment temperatures, tend to afford more rapid formation of the lubricity-enhancing coating.

Contacting of the surface of the ferrous metal with the aqueous mixture can be by any means known in the art, and may include for example spraying, roller coating, and dipping. In many cases, dipping of the ferrous metal item into a bath of the aqueous mixture is preferred. The contact time between the mixture and the ferrous metal item may typically be between about 1 and 15 minutes, more typically between about 2 and 10 minutes. Optimal conditions may vary somewhat, depending on the precise composition, temperature, and pH of the aqueous mixture, as well as the exact type of ferrous metal being treated, as will be appreciated by the skilled artisan.

Ferrous metals suitable for treatment using the compositions and processes of this invention include, but are not limited to, conventional steels such as high-carbon steels (typically grades 1060C–1080C), medium-carbon steels (typically 1021C–1055C), and low-carbon steels (typically grades 1006C–1020C). Typical treatment temperatures for these are 150–200° F., 170–200° F., and 190–200° F. respectively. One indication that an appropriate level of treatment has been achieved is the appearance of a gray or black coating on the treated item. It is believed that some amount of ferrous and/or ferric ion is produced during the treatment, and that at least some of this ionic iron becomes incorporated into the coating. It is also believed that some of the aluminum, the boric acid, the polyvalent carboxylic acid, the polyol, and the rust inhibitor are also incorporated into the coating.

Metalworking with ferrous metals treated according to the invention may be performed by standard methods known to the skilled artisan. Such metalworking includes for example wire drawing, cold heading, and the application of protective coatings. Treatment of ferrous metals according to the invention is particularly well suited to providing lubricity for metal drawing processes, such as the manufacture of wire.

Ferrous metals treated according to the invention may optionally be contacted with other lubricity-enhancing agents such as are known in the art. Such agents include for example graphite or soaps, and these materials may be entrained by the rough surface provided by the surface treatment of the invention. They are subsequently carried along into the metalworking process, where they augment the lubricity provided by the coating produced as described above.

EXPERIMENTAL SECTION

EXAMPLES 1–3

Compositions were prepared with the following ingredients, each given as wt. % of the total as shown in Table 1:

TABLE 1

| INGREDIENT | Example 1 | Example 2 | Example 3 |
|---|---|---|---|
| Aluminum Sulfate | 60.0 | 80.0 | 57.1 |
| Boric Acid | 10.0 | 15.0 | 13.4 |
| Oxalic Acid | 13.0 | | 10.0 |
| Citric Acid | 5.0 | 5.0 | 5.0 |
| Adipic Acid | 5.0 | | 5.0 |
| Trimethylol Propane | 5.0 | | 2.0 |
| Pentaerythritol | | | 3.0 |
| Azelaic Acid | 1.6 | | 1.0 |
| L-Aspartic Acid | | | 3.0 |
| Polyacrylic Acid | 0.1 | | |
| MIP Graphite | 0.1 | | |
| Aerosil ® 200 | | | 0.5 |
| TOTAL | 99.8 | 100.0 | 100.0 |

For each formulation, a "Q" panel and a rod at each of three carbon content levels (1004C, 1040C, and 1082C) was treated as follows. The raw materials as shown in Table 1 were weighed out and mixed in a blender at slow speed to give a uniform mixture. A 20-gram portion of the resulting mixture was dissolved in 100 grams of water. The resulting mixture had a pH of about 2.5, and the steel piece (either a steel "Q" panel or a rod) was immersed for 5 minutes. Coating weights resulting from the treatment of the panels, and lubrication results from the treatment of the rods, are shown in Table 2.

TABLE 2

| Test Item | Example 1 | Example 2 | Example 3 |
|---|---|---|---|
| 1004C panel | 200 mg/ft$^2$ | 220 mg/ft$^2$ | 457 mg/ft$^2$ |
| 1040C panel | 504 mg/ft$^2$ | 532 mg/ft$^2$ | 899 mg/ft$^2$ |
| 1082C panel | 700 mg/ft$^2$ | 719 mg/ft$^2$ | 1200 mg/ft$^2$ |
| 1004C rod | very good | very good | very good |
| 1040C rod | very good | very good | very good |
| 1082C rod | very good | very good | very good |

In all cases, the panels were subjected to a bend test (ASTM D 522), and found to show no flake-off of the coating, indicating good coating integrity.

Lubrication tests were performed on a Warfner testing unit. In all cases, higher lubrication was obtained than for control experiments performed with a standard zinc phosphate coating.

While preferred embodiments of the invention have been described herein, it will be understood that such embodiments are provided by way of example only. Numerous variations, changes and substitutions will occur to those skilled in the art, without departing from the spirit of the invention. Accordingly, it is intended that the appended claims cover all such variations as fall within the spirit and scope of the invention.

What is claimed:

1. A composition for treating the surface of a ferrous metal, the composition comprising:

a) at least one of aluminum sulfate and an aluminum sulfate precursor;

b) at least one of boric acid and a boric acid precursor;

c) at least one of a polycarboxylic acid and a polycarboxylic acid precursor selected from the group consisting of oxalic acid, malonic acid, succinic acid, glutaric add, adipic acid, azelaic acid, citric acid, aspartic acid, glutamic acid, a precursor of any of these, and mixtures of any of these; and d) a polyol comprising at least one of trimethylolpropane, pentaerythritol, and dipentaerythritol.

2. The composition of claim 1, wherein said polyol comprises at least one of trimethylolpropane and pentaerythritol.

3. A composition for treating the surface of a ferrous metal, the composition comprising:

a) between about 40 wt. % and about 80 wt. % of aluminum sulfate;

b) between about 10 wt. % and about 20 wt. % total of at least one of boric acid and a boric acid precursor; and c) between about 10 wt. % and about 20 wt. % total of at least one of a polycarboxylic acid and a polycarboxylic acid precursor selected from the group consisting of oxalic acid, malonlc acid, succinic acid, glutaric acid, adipic acid, azelaic acid, citric acid, aspartic acid, glutamlc acid, a precursor of any of these, and mixtures of any of these.

4. The composition of claim 3 wherein said at least one of a polycarboxylic acid and a polycarboxylic acid precursor is setected from the group consisting or oxalic acid, malonic acid, succinic acid, glutaric acid, azelaic acid, a precursor of any of these, and mixtures of any or these, the composition further comprising:

d) between about 5 wt. % and about 10 wt. % of citric acid;

e) between about 2 wt. % and about 5 wt. % of pentaerythritol;

f) between about 2 wt. % and about 5 wt. % of adipic acid; and g) between about 1 wt. % and about 3 wt. % of L-aspartic acid.

5. The composition according to claim 3, wherein the polycarboxylic acid is a mixture of oxalic acid and citric acid.

6. A composition for treating the surface of a ferrous metal, the composition comprising:

a) between about 50 wt. % and about 70 wt. % of aluminum sulfate;

b) between about 10 wt. % and about 15 wt. % of boric acid;

c) between about 5 wt. % and about 15 wt. % of oxalic acid;

d) between about 2 wt. % and about 7 wt. % of citric acid;
e) between about 2 wt. % and about 7 wt. % of adipic acid;
f) between about 1 wt. % and about 5 wt. % of pentaerythritol;
g) between about 1 wt. % and about 5 wt. % of trimethylolpropane;
h) between about 0.5 wt. % and about 2 wt. % of azelaic acid; and
i) between about 1 wt. % and about 5 wt. % of L-aspartic acid, D-aspartic acid, or a mixture thereof.

7. A method for treating the surface of a ferrous metal, comprising contacting the surface of a ferrous metal with an aqueous mixture comprising:
a) aluminum sulfate;
b) boric acid; and
c) a polycarboxylic acid selected from the group consisting of oxalic acid, malonic acid, succinic acid, glutaric acid, adipic acid, azelaic acid, citric acid, aspartic acid, glutamic acid, and mixtures of any of these, wherein said ferrous metal is a low-carbon steel, and wherein the contacting step comprises contacting the surface of the ferrous metal with the aqueous mixture at a temperature between about 185° F. and about 200° F.

8. The method according to claim 7, wherein the polycarboxylic acid is a mixture of oxalic acid and citric acid.

9. A method for treating the surface of a ferrous metal, comprising contacting the surface of a ferrous metal with an aqueous mixture comprising:
a) aluminum sulfate;
b) boric acid; and
c) a polycarboxylic acid selected from the group consisting of oxalic acid, malonic acid, succinic acid, glutaric acid, adipic acid, azelaic acid, citric acid, aspartic acid, glutamic acid, and mixtures of any of these, wherein said ferrous metal is a medium-carbon steel, and wherein the contacting step comprises contacting the surface of the ferrous metal with the aqueous mixture at a temperature between about 170° F. and about 200° F.

10. The method according to claim 9, wherein the polycarboxylic acid is a mixture or oxalic acid and citric acid.

11. A method for treating the surface of a ferrous metal, comprising contacting the surface of a ferrous metal with an aqueous mixture comprising:
a) aluminum sulfate;
b) boric acid; and
c) a polycarboxylic acid selected from the group consisting of oxalic acid, malonic acid, succinic acid, glutaric acid, adipic acid, azelaic acid, citric acid, aspartic acid, glutamic acid, and mixtures of any of these, wherein said polycarboxylic acid is selected from the group consisting of oxalic acid, malonic acid, succinic acid, glutaric acid, adipic acid, azelaic acid, citric acid, and mixtures of any of these, the aqueous mixture further comprising at least one of L-aspartic acid and D-aspartic acid.

12. A method for treating the surface of a ferrous metal, comprising contacting the surface of a ferrous metal with an aqueous mixture comprising:
a) aluminum sulfate;
b) boric acid; and
c) a polycarboxylic acid selected from the group consisting of oxalic acid, malonic acid, succinic acid, glutaric acid, adipic acid, azelaic acid, citric acid, aspartic acid, glutamic acid, and mixtures of any of these, wherein said polycarboxylic acid is selected from the group consisting of oxalic acid, malonic acid, succinic acid, glutaric acid, citric acid, aspartic acid, glutamic acid, and mixtures of any of these, the aqueous mixture further comprising at least one of adipic acid and azelaic acid.

13. An aqueous mixture for treating the surface of a ferrous metal, the mixture comprising:
a) aluminum sulfate;
b) boric acid;
c) citric acid; and
d) a polyol comprising at least one of trimethylolpropane, pentaerythritol, and dipentaerythritol.

14. The aqueous mixture or claim 13, wherein said polyol comprises at least one of trimethylolpropane and pentaerythritol.

15. An aqueous mixture for treating the surface of a ferrous metal, the mixture comprising a composition comprising:
a) between about 40 wt. % and about 80 wt. % of aluminum sulfate;
b) between about 10 Wt. % and about 20 wt. % of boric acid; and
c) between about 10 wt. % and about 20 wt. % total of a polycarboxylic acid selected from the group consisting of oxalic acid, malonic acid, succinic acid, glutaric acid, adipic acid, azelaic acid, citric acid, aspartic acid, glutamic acid, and mixtures of any of these.

16. The aqueous mixture of claim 15 wherein the polycarboxylic acid is selected from the group consisting of oxalic acid, malonic acid, succinic acid, glutaric acid, azelaic acid, and mixtures of any of these, the composition further comprising:
d) between about 5 wt. % and about 10 wt. % of citric acid;
e) between about 2 wt. % and about 5 wt. % of pentaerythritol;
f) between about 2 wt. % and about 5 wt. % of adipic acid; and
g) between about 1 wt. % and about 3 wt. % of L-aspartic acid.

17. The aqueous mixture according to claim 15, wherein the polycarboxylic acid is a mixture of oxalic acid and citric acid.

18. An aqueous mixture for treating the surface of a ferrous metal, the composition comprising the following materials in the following relative amounts, exclusive of added water:
a) between about 50 wt. % and about 70 wt. % of aluminum sulfate;
b) between about 10 wt. % and about 15 wt. % of boric acid;
c) between about 5 wt. % and about 15 wt. % of oxalic acid;
d) between about 2 wt. % and about 7 wt. % of citric acid;
e) between about 2 wt. % and about 7 wt. % or adipic acid;
f) between about 1 wt. % and about 5 wt. % of pentaerythritol;
g) between about 1 wt. % and about 5 wt. % of trimethylolpropane;
h) between about 0.5% and about 2 wt. % of azelaic acid; and
i) between about 1 wt. % and about 5 wt. % of L-aspartic acid, D-aspartic acid, or a mixture thereof.

* * * * *

UNITED STATES PATENT AND TRADEMARK OFFICE

CERTIFICATE OF CORRECTION

PATENT NO. : 7,037,384 B2
APPLICATION NO. : 10/601939
DATED : May 2, 2006
INVENTOR(S) : David Roy Pawloski It is certified that error appears in the above-identified patent and that said Letters Patent is hereby corrected as shown below:

At column 8, line 22, delete "add" and insert therefor --acid--.

At column 10, line 21, delete "10 Wt. %" and insert therefor --10 wt. %--.

Signed and Sealed this

Twenty-eighth Day of November, 2006

JON W. DUDAS
*Director of the United States Patent and Trademark Office*